United States Patent [19]

Gaia

[11] Patent Number: 4,559,513

[45] Date of Patent: Dec. 17, 1985

[54] TRIGGER MECHANISM FOR DUAL-ELEMENT FUSE

[75] Inventor: Aldino J. Gaia, St. Louis, Mo.

[73] Assignee: Cooper Industries, Inc., Houston, Tex.

[21] Appl. No.: 649,135

[22] Filed: Sep. 10, 1984

[51] Int. Cl.[4] ..... H01H 85/04

[52] U.S. Cl. ..... 337/165; 337/163

[58] Field of Search ..... 337/165, 166, 164, 163

[56] References Cited

U.S. PATENT DOCUMENTS

| | | | |
|---|---|---|---|
| 2,210,036 | 8/1940 | McEntee | 337/165 |
| 2,293,953 | 8/1942 | Taylor | 337/165 |
| 2,506,304 | 5/1950 | Ludwig | 337/166 |

*Primary Examiner*—Harold Broome

*Attorney, Agent, or Firm*—Eddie E. Scott; Nelson A. Blish; Alan R. Thiele

[57] ABSTRACT

A generally U-shaped connector is included in a current limiting fuse having first and second interior conductor members. The connector is disposed between the first and second conductor members, and completes an electrical circuit therebetween. The first conductor member has a free end which is received between the legs of the U-shaped connector and is secured thereto by a first mass of heat softenable alloy. The second conductor member underlies a leg of the connector, and is secured thereto by a second mass of heat softenable alloy. A hook-like projection struck out of the bight of the U-shaped connector receives a loop end of a spring which biases the connector for circuit-opening movement away from the first conductor member. Upon conducting a small protracted overcurrent, the conductor members and connector are heated to soften the alloy masses, allowing circuit-opening movement of the spring biased connector away from the first conductor member.

8 Claims, 5 Drawing Figures

TRIGGER MECHANISM FOR DUAL-ELEMENT FUSE

BACKGROUND OF THE INVENTION

This invention relates to dual-element current limiting electric fuses, and in particular to such fuses having circuit-completing triggers or connectors biased for circuit-opening movement.

Dual-element fuses of the afore-mentioned type normally have at least two spaced-apart electrical conductor members which are connected together by a trigger. Prior art triggers are connected to two fuse conductor members by heat softenable alloy, and are typically biased for circuit-opening movement out of contact with those fuse conductor members. Circuit opening movement is initiated when the alloy securing the trigger softens in response to a prolonged, relatively low overcurrent.

Prior art time delay fuses, such as that disclosed in U.S. Pat. No. 3,845,111, assigned to the same assignee as the present invention, have been provided with circuit-opening triggers which are characterized by multiple contact surfaces formed by interior wall members. Such a prior art trigger is typically made from an elongated strip of copper or other soft metal, which is formed into an S-shaped configuration. The S-shaped configuration provides first and second U-shaped cavities which are separated by an intermediate common wall. A first U-shaped cavity receives a free end of a first fuse conductor member and a second U-shaped cavity receives the free end of a spring member which biases the trigger for circuit-opening movement. The second U-shaped cavity is compressed to retain the spring in place by friction. Heat softenable alloy is applied to fill the remaining open areas of both cavities. The bottom-most surface of the S-shaped trigger is also secured to the free end of a second fuse conductor member by heat softenable alloy. Rather than apply discrete quantities of heat softenable alloy to the first and second U-shaped cavities and bottom surface of the trigger, commercial practice is to apply a large mass of heat softenable alloy which is typically poured over the entire trigger, after the trigger is positioned with respect to the first and second fuse conductor members and the spring bias member. While a greater quantity of heat softenable alloy is required for this construction, fabrication of the current limiting fuse is nevertheless simplified and provides a competitive cost advantage to the manufacturer of such fuses.

In response to a prolonged, relatively low, but potentially dangerous, overcurrent, the alloy softens allowing the trigger to be moved under the bias force of the spring member relative to the first and second fuse conductor members. Movement of the trigger accomplishes circuit opening by effectively withdrawing the free end of the first fuse conductor from the trigger cavity within which it is received. Resistance heating generated by the overcurrent, and which softens the alloy, continues to build even after circuit-opening movement of the trigger is initiated. In addition to resistance heating, extremely high temperature arcing is commonly experienced during circuit-opening movement of the trigger as it is separated from the first fuse conductor. As a result, the heat softenable alloy melts and, while in a fluid state, presents a risk of reconnecting the fuse conductor members after circuit clearing is initiated.

The legs of the S-shaped trigger defining the first U-shaped cavity of the trigger which receives the first fuse conductor member, are typically elongated, are closely spaced to minimize the amount of heat softenable alloy required to fill the cavity, and are positioned generally parallel to the first fuse conductor members. Because of the arrangement of the legs, it is sometimes difficult to achieve circuit-opening movement. As a result of the contact between the trigger and the first conductor member, frictional forces are experienced during retraction which can impair the circuit-opening capability of the fuse. Possible increases in the spring bias force to overcome these frictional forces are limited, in that unduly bulky springs cannot be accommodated within the confines of the current limiting fuse, and also, since increases in the spring force may jeopardize the mechanical securement of the spring to the trigger. Increases in spring force could also cause difficulties in maintaining the mechanical connection between the bias spring and the trigger because of "spring-back" of the trigger caused by the release of the compression engagement of the trigger about the spring loop. This "spring-back" phenomena tends to separate the adjacent folded portions of the trigger thereby lessening the capability of the trigger to engage the spring loop.

SUMMARY OF THE INVENTION

Accordingly, it is a primary object of the present invention to provide a current limiting fuse including an improved trigger which overcomes the drawbacks of triggers found in prior art fuses of the type described heretofore.

It is another object of the present invention to provide a current limiting fuse of the afore-mentioned type including a new and improved trigger which uses significantly less heat softenable alloy in the assembly thereof.

It is yet another object of the present invention to provide a trigger for a current limiting fuse of the type described heretofore which is more reliable, less complex in construction, easy to assemble and yet efficient in operation.

It is still another object of this invention to provide a current limiting fuse including a new and improved trigger which has the same overall dimensions as those in prior dual element fuses and which is a direct replacement for those in such prior fuses.

The foregoing objects are accomplished in accordance with this invention, in one form thereof, by providing a current limiting fuse having a trigger of generally U-shaped configuration. The U-shaped trigger is positioned on its side, thus having a top leg, a bottom leg, and an intermediate generally vertically extending bight portion. The trigger is disposed between first and second parallel, laterally spaced-apart interior fuse conductor members, and is secured thereto by first and second masses of heat softenable alloy. The conductor members extend substantially parallel to the legs of the trigger. The first conductor member is disposed above the second conductor member, and has a free end which is inserted into the interior of the U-shaped trigger. The bottom surface of the top leg of the U-shaped trigger overlies the free end of the first conductor member and is secured thereto by a first mass of heat softenable alloy. The bottom surface of the bottom leg of the trigger overlies the second conductor member, and is secured thereto by a second mass of heat softenable alloy. The trigger completes a circuit between the first and second spaced-apart conductor members, and is spring biased for circuit-opening movement away from the first fuse conductor member. A hook-like projection is struck out of the bight portion of the trigger and receives a looped end of the bias spring.

Upon conducting protracted overcurrents of relatively small magnitude, the trigger and conductor members are heated and soften the alloy masses which provide securement therebetween. When the first and second alloy masses are sufficiently softened, the trigger is moved out of contact with the first fuse conductor member under the force of the bias spring, thereby to break the electrical circuit between the first and second fuse conductor members, and hence to break the electrical circuit through the current limiting fuse.

DESCRIPTION OF THE PREFERRED EMBODIMENT

Figure 1:
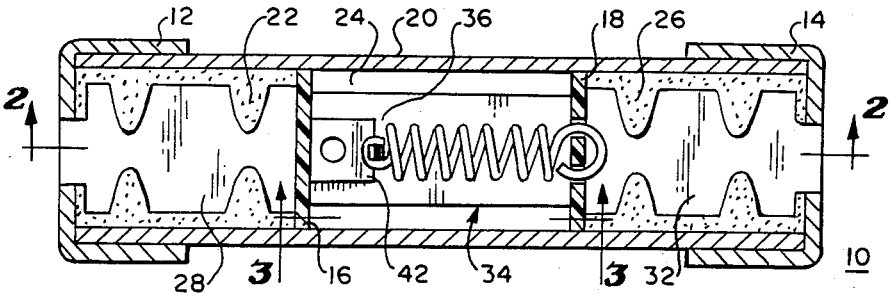
FIG. 1 is a cross-sectional plan view of a dual-element electric fuse employing the trigger of the present invention.

Referring now to the drawing in greater detail, and especially to FIG. 1, a dual-element fuse 10 includes a cylindrical casing 20 formed of a dielectric material, such as fiber or melamine. Metallic ferrules 12, 14 are telescoped over opposite ends of cylindrical casing 20 to provide an electrical connection with an external electrical circuit (not shown). Interior walls 16, 18 provide three isolated interior compartments 22, 24 and 26, respectively within casing 20. A first fusible conductor member 28, located in first compartment 22, has a free end portion 30 which projects into the centrally disposed second compartment 24. A second fusible conductor member 32 is located in third compartment 26 and has an end 33 which projects into the second or central compartment 24. Second fusible conductor member 32 is connected at its first end 33 to the second end of metallic heat absorber 34 by a pair of tangs 37 which protrude from the bottom of heat absorber 34. The first end of heat absorber 34 is supported by interior wall 16.

A U-shaped trigger 42, according to the present invention, is shown installed between end portion 30 of the first fusible conductor member 28 and the upper surface 36 of heat absorber 34. Trigger 42 is formed of copper or other relatively soft metal, and comprises a first leg 44 oriented horizonally, as shown in the drawing, a lower leg 48 also oriented horizonally and a bight portion 46 joining legs 44 and 48. The bottom surface 50 of upper leg 44 overlies end portion 30 of fusible conductor member 28 and is bonded thereto by a mass of heat softenable alloy 52. A hole 53 is provided in leg 44 to facilitate rapid insertion of the heat softenable alloy between conductor 28 and leg 44. A bottom exterior surface 54 of lower trigger leg 48 is bonded to the upper surface 36 of heat absorber 34 by heat softenable alloy mass 38. A hook-like projection 58 protudes from the bight portion 46 of trigger 42 and receives a first end 59 of a spring 60 which is attached thereto. Second end 61 of spring 60 is secured to interior wall 18, thereby to maintain the spring in a tensioned condition. Hook-like projection 58 provides positive and reliable securement for looped spring end 59. Such method of attachment is superior to the attachment of prior bias springs which are often compressed between adjacent folded layers of the trigger.

Only two relatively small masses of heat softenable alloy 38, 52 are required to hold trigger connector 42 in place between the two spaced-apart conductor members 28, 34. This represents a significant savings in the total quantity of alloy required for a fuse of the type described, as compared to prior art triggers which are substantially covered with alloy. For example, in one preferred embodiment of a fuse, according to the invention, the trigger for a 100 ampere, 250 volt fuse utilized 66 percent less heat softenable alloy than a comparable trigger of the above-referenced prior art fuse. Furthermore, a lighter gauge copper material may be used in fabricating the trigger of the present invention, since the trigger is not required to withstand a 180-degree bend, as in prior art trigger connectors where portions of the copper strip were folded back on themselves. Thus, a savings in copper as well as in heat softenable alloy is realized with the trigger of the present invention.

Trigger 42 of the present invention allows rapid assembly and positive securement to adjoining conductor members during fabrication of the fuse. Only two flat surfaces 50, 54 of trigger 42 need be aligned and joined together with first and second masses of heat softenable alloy 38, 52. Alloy masses 38, 52 need not be flowed into crevices as was necessary with blind alloy connections of the afore-mentioned prior art triggers. Hence, less heat is required to assemble fuse employing trigger of the present invention. This results in less assembly time and also reduces the risk of injury to adjacent fusible conductor member 28, 32.

In operation upon conducting a heavy overload or short circuit, the fusible conductor members 28, 32 will rupture to open the circuit through the fuse. These same fusible conductor members 28, 30 will remain intact when fuse 10 is made to carry a relatively low magnitude, but potentially dangerous overcurrent of prolonged duration, wherein trigger 42 of the present invention operates to interrupt current flow through the fuse. Upon conducting an overcurrent for a sufficiently long time, alloy masses 38, 52 soften to permit circuit opening movement of trigger 42 away from fusible conductor 28 under the bias force of spring 60.

Figure 2:
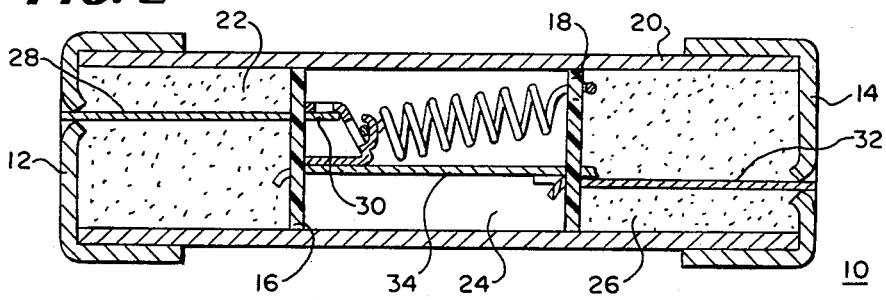
FIG. 2 is a cross-sectional elevational view taken along the lines 2—2 of the electric fuse of FIG. 1.

Referring especially to FIG. 2, it can be seen that fuse 10 shown therein, includes vertically-spaced horizontal conductor members 28 and 32 which are joined by trigger 42. To allow spring 60 to be outstretched as much as possible within central compartment 24, second end 61 of spring 60 is secured to intermediate wall 18 near the upper portion thereof. This arrangement of spring 60 imparts a vertically directed force to trigger 42, i.e. a force generally perpendicular to the direction of extension of the conductor members. If spring 60 were to provide an overall resultant force parallel to conductor member 28 and heat absorber 34, there is a possibility that, due to frictional forces and the like, occurring between parallel contiguous surfaces, circuit-opening retraction of trigger 42 may be hampered, not allowing a total break of the connection between conductor members 28, 32.

Figure 3:
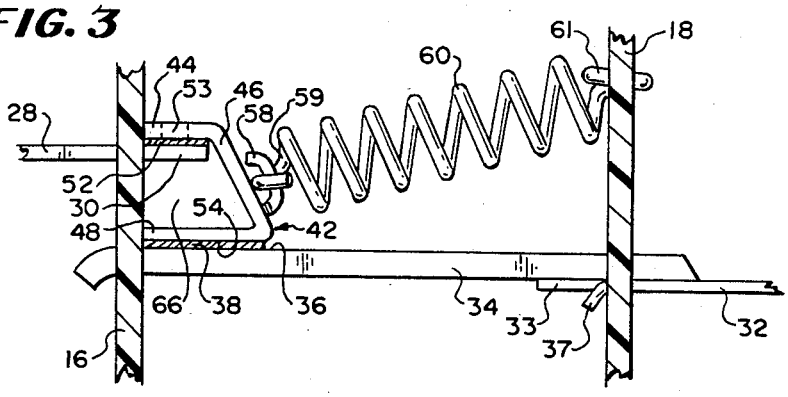
FIG. 3 is an enlarged view of the central portion of the electric fuse of FIG. 2, showing the U-shaped trigger in greater detail.
Figure 4:
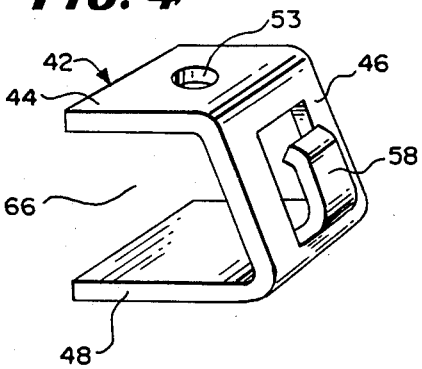
FIG. 4 is a perspective view of the trigger according to the present invention.
Figure 5:
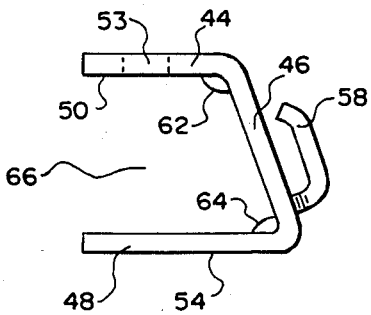
FIG. 5 is a side elevational view of the trigger of FIG. 4.

Accordingly, bight portion 46 of trigger 42 is preferably slightly inclined from the vertical, as is most clearly shown in FIGS. 3 and 5, to present a mounting surface as nearly perpendicular as is possible with respect to the resultant force of spring 60. As shown in FIG. 5, bight portion 46 is skewed at an angle from the vertical, to provide improved trouble-free clearing movement of trigger member 42, and to further reduce the likelihood that trigger 42 will hang up or snag on free end 30 of fusible conductor member 28. The interior angles 62, 64 of trigger 42 are approximately 100 degrees, and 70 degrees, respectively.

The U-shaped trigger of this invention has approximately the same exterior dimensions as prior art S-shaped connector members. By eliminating the intermediate folds of the prior art triggers described heretofore, a larger concave interior is created for the fuse conductor member inserted therein. This enlarhged interior provides a greater degree of freedom between the first conductor member and the triger during circuit-opening movement of the trigger. With reference to FIG. 2, fuse 10 within which the trigger 42 is employed, is of a standard design and, in particular, the vertical spacing between fusible conductor members 28, 32 is of standard dimension. Prior art triggers of S-shaped configuration have a horizontal wall interposed between the top and bottom walls thereof, which greatly reduces the opening within which free end 30 of fusible conductor member 28 is received. As can be seen from the arrangement of FIG. 2, the end 30 of fusible connector member 28 is received within opening 66 formed between legs 44, 48 of the U-shaped trigger. Inasmuch as there are no intermediate folds between legs 44, 48, a greater freedom of movement is permitted the trigger 42 during circuit-opening operation under the bias force of spring 60. This configuration of trigger 42, according to the invention, allows the trigger to be separated from both conductor members 28, 32 while avoiding the risk of the lower leg 48 engaging free end 30 of fusible conductor member 28. A significant improvement over prior art trigger connectors is realized by the present invention in that there are no obstructions between legs 44, 48 of trigger 42.

Although circuit-opening retraction of trigger 42 can be accomplished without completely melting heat softenable alloy masses 52, 38, heat continues to build up in these alloy masses even after circuit-opening movement of the trigger 42 is initiated. In many cases, this heat build-up is sufficient to melt the alloy which secures trigger connector 42 to the conductor members. Further, any arcing between the trigger 42 and adjacent conductor m embers 28, 34 which may occur during circuit-opening operation, readily melts any alloy used in the trigger.

Thus, it can be seen that if the fuse of FIG. 2 is mounted in a vertical direction, with intermediate wall 16 disposed below the trigger, any molten alloy surrounding the trigger connector will tend to flow downwardly against the intermediate wall 16, between adjacent members 28, 32. If the quantity of molten alloy is sufficiently large, as in prior art fuses, the circuit between fusible conductor members 28, 32 could be reestablished by a molten alloy bridge, and the fuse will fail to clear in a proper manner. Therefore, in the case of the fuse of the subject invention, reliability of circuit-opening operation is enhanced by a reduction in the quantity of heat softenable alloy required.

Thus, it can be seen that the present invention provides a fuse employing a unique trigger which rquires a lesser quantity of heat softenable alloy then prior fuses of this type, assures positive connection of a bias member connected thereto, affords a positive assembly which can be visually inspected provides enhanced pull-off circuit-opening movement and is of a simplified construction which is easier to fabricate.

I claim:

1. An electric current limiting fuse comprising first and second spaced conductor members, a relatively rigid, one-piece trigger of a generally U-shaped configuration, said trigger having first and second legs joined by a bight portion, a first mass of heat softenable alloy connecting said first leg of said trigger to said first conductor member and a second mass of heat softenable alloy connecting said second leg of said trigger to said second conductor member to complete an electrical circuit therebetween, biasing means attached to the bight portion of said trigger, and said first conductor member having a substantially planar free end underlying said first leg of said trigger and said second conductor member having a substantially planar upper surface portion underlying said second leg of said trigger, said planar surfaces being substantially parallel and said biasing means urging said trigger in a direction at an essentially acute angle to said planar surfaces to effect rapid and complete separation between the trigger and the conductor members upon conducting an overcurrent of relatively low, but potentially hurtful magnitude, through said masses of heat softenable alloy causing them to soften to permit circuit-opening movement of said trigger.

2. An electric current limiting fuse comprising first and second spaced conductor members, a one-piece trigger being generally U-shaped, said trigger having first and second legs joined by a bight portion, a first mass of heat softenable alloy connecting said first leg of said trigger to said first conductor member and a second mass of heat softenable alloy connecting said second leg of said trigger to said second conductor member to complete an electrical circuit therebetween, biasing means attached to the bight portion of said trigger, and said first conductor member having a substantially planar free end underlying said first leg of said trigger and said second conductor member having a substantially planar upper surface portion underlying said second leg of said trigger, said planar surfaces being substantially parallel and said biasing means urging said trigger in a direction inclined at least 20° with respect to said parallel planar surfaces, whereby, upon conducting an overcurrent of relatively low, but potentially hurtful magnitude, said masses of heat softenable alloy soften to permit circuit-opening movement of said trigger.

3. The fuse as claimed in claim 1, wherein said trigger is formed of a unitary piece of metal.

4. The fuse as claimed in claim 1, wherein said bight forms interior angles with said first and second legs of approximately 110° and 70°, respectively.

5. The fuse as claimed in claim 1, wherein said bight portion of said trigger includes a hook-like projection for securing said biasing means to said trigger, said biasing means including a spring, said biasing means exerting a force on said trigger in a direction substantially perpendicular to said bight of said trigger.

6. The fuse as claimed in claim 1, wherein said fuse is elongated and cylindrical in shape and has a center axis, said first and second conductor members being elongated and having axes which extend parallel to said center of said fuse, said biasing means producing a force on said trigger said force having a major component thereof parallel to said center axis of said fuse, and a smaller component thereof normal to said center axis of said fuse.

7. The fuse as claimed in claim 1, wherein said trigger is formed of a unitary piece of metal.

8. The fuse as claimed in claim 1, wherein said bight portion of said trigger includes a hook-like projection for attaching said biasing means to said trigger, said biasing means including a coil spring, which exerts a force on said trigger in a direction substantially perpendicular to said bight of said trigger.

* * * * *